US006858250B2

(12) United States Patent
Fort

(10) Patent No.: US 6,858,250 B2
(45) Date of Patent: Feb. 22, 2005

(54) APPARATUS AND METHOD FOR APPLYING SIFTPROOF ADHESIVE PATTERN

(75) Inventor: Wesley C Fort, Cumming, GA (US)

(73) Assignee: Nordson Corporation, Westlake, OH (US)

( * ) Notice: Subject to any disclaimer, the term of this patent is extended or adjusted under 35 U.S.C. 154(b) by 151 days.

(21) Appl. No.: 10/279,600

(22) Filed: Oct. 24, 2002

(65) Prior Publication Data

US 2003/0049371 A1 Mar. 13, 2003

Related U.S. Application Data

(63) Continuation-in-part of application No. 09/702,430, filed on Oct. 31, 2000, now Pat. No. 6,586,050.

(51) Int. Cl.[7] ..... B05D 1/26; B05D 5/10

(52) U.S. Cl. ..... 427/207.1; 427/208.6; 427/284; 427/286; 427/288

(58) Field of Search ..... 427/207.1, 208.2–208.6, 427/256, 284, 286, 288; 118/313–315, 323, 224

(56) References Cited

U.S. PATENT DOCUMENTS

| | | | | |
|---|---|---|---|---|
| 3,194,474 A | | 7/1965 | Rumberger | 129/37 |
| 3,348,519 A | | 10/1967 | Dyess, Jr. et al. | 118/2 |
| 3,831,342 A | * | 8/1974 | Rejsa | |
| 3,934,791 A | | 1/1976 | Dick et al. | 229/37 |
| 4,009,498 A | | 3/1977 | Staats et al. | 11/1 |
| 4,010,203 A | | 3/1977 | Aylon | 156/578 |
| 4,256,526 A | * | 3/1981 | McDaniel | |
| 4,484,850 A | | 11/1984 | Shimizu | 412/11 |
| 4,498,618 A | | 2/1985 | Roccaforte | 229/52 |
| 4,836,440 A | * | 6/1989 | French | |
| 4,861,325 A | * | 8/1989 | DiMarzio et al. | |
| 5,401,791 A | | 3/1995 | Milks | 524/270 |
| 5,426,920 A | | 6/1995 | Quadalti | 53/564 |
| 5,472,137 A | | 12/1995 | Jenkins | 229/134 |
| 5,540,774 A | | 7/1996 | Smitherman | 118/315 |
| 5,688,218 A | | 11/1997 | Jenkins | 493/151 |
| 5,711,477 A | | 1/1998 | Jenkins | 229/136 |
| 5,773,095 A | | 6/1998 | Coker | 427/424 |
| 5,806,756 A | | 9/1998 | Jenkins | 229/136 |
| 5,876,502 A | * | 3/1999 | Sugimura et al. | |

OTHER PUBLICATIONS

Industrial Devices Corporation, *Linear & Rotary Positioning Systems & Controls*, Catalog, 1998.
Senzani USA Corporation, *Vertical Cartoning Machines*, Brochure, Oct. 1998.
*Sketch of Senzani Rotary Adhesive Applicator*, 1996.
Nordson Corporation, engineering drawings of prior adhesive patterns on adhesive flaps, numbered 1–117, undated.

* cited by examiner

*Primary Examiner*—Fred J. Parker
(74) *Attorney, Agent, or Firm*—Wood, Herron & Evans, L.L.P.

(57) ABSTRACT

A method of applying adhesive to major and minor flaps of a container in a siftproof adhesive pattern. A pair of adhesive dispensing guns are moved with respect to the flaps of the container as the container is conveyed past the guns. Electric actuators, such as linear modules or rotatable servo modules, are used to rapidly accelerate the guns in a direction perpendicular to the path of the container along a conveyor. In this manner, rapid packaging takes place and reliable siftproof patterns are achieved using minimal adhesive.

9 Claims, 6 Drawing Sheets

APPARATUS AND METHOD FOR APPLYING SIFTPROOF ADHESIVE PATTERN

This application is a continuation-in-part of application Ser. No. 09/702,430 filed Oct. 31, 2000 (now U.S. Pat. No. 6,586,050), the disclosure of which is fully incorporated herein by reference.

FIELD OF THE INVENTION

The present invention generally relates to apparatus and methods for sealing containers and, more specifically, to apparatus and methods of sealing containers in a siftproof manner designed to prevent leakage of particulate contents or infestation by insects.

BACKGROUND OF THE INVENTION

Many containers, such as cartons, boxes or other less rigid containers, are constructed from paper-based materials and include open ends each having a plurality of flaps. Typically, the flaps at each end include a pair of opposed major flaps and a pair of opposed minor flaps. The containers are usually folded from a flat condition into an erected condition, after which a desired product may be introduced into the container. The flaps are then folded and connected together, typically using an adhesive, to close the opposite ends of the container. The minor flaps are folded down first and the major flaps are folded down next and sealed to upper surfaces of the minor flaps using adhesive.

Particulate products, such as granulated or powdered products, require packaging that prevents leakage of the product during shipment and storage. Plastic liners may be used inside the container for this purpose, however, such liners increase packaging costs. To reduce costs, linerless siftproof containers and sealing methods have been developed for storing and shipping particulate products. The end flaps of these siftproof containers must be tightly sealed in a manner that prevents the contents from sifting out between the flaps and which likewise prevents infestation by insects through gaps between the flaps. In the past, all of the flaps have received adhesive deposits in the form of intermittent or continuous adhesive beads to ensure that the seams between the various flaps are sealed in a siftproof manner.

As the development of siftproof containers has progressed, certain problems have been addressed relative to siftproof seal integrity and costs associated with the adhesive and the paper construction products.

For example, embossments have been used on the various flaps to provide opposed surfaces lying in close relation such that the gap between the flaps does not need to be filled with as much adhesive. Other siftproof containers have been configured to include a modified first major flap that enables direct contact between embossed portions of the minor flaps and a corresponding embossed portion of the second major flap. While these improvements have helped in some regards, modifying containers in these manners can also add expense and some containers cannot have embossed or otherwise modified flaps.

Other problems in this art relate to the need for a large of number of adhesive dispensers, or adhesive dispensing nozzles, necessary to place the corresponding number of beads on the container flaps extending in the conveying path of the containers. The increased complexity of the dispensing system increases costs and complicates changeover procedures. In this latter regard, for containers of different configurations and/or sizes, dispensing guns must be removed or added, or nozzles must be removed and plugged or added to accommodate the new configuration or container size.

Despite the various developments in the area of siftproof containers, improvements are still needed to maintain siftproof seal integrity while reducing adhesive requirements and general manufacturing costs. In this regard, the use of continuous adhesive sealing beads as opposed to a number of intermittent short and long beads only extending parallel to the conveying path requires much less adhesive and lower manufacturing equipment and changeover costs due to the lower number of necessary adhesive guns. However, applying a continuous adhesive bead in a direction generally perpendicular to the conveying path during high-speed packaging operations has been a troublesome problem. Many packaging lines are designed to move at a rate of approximately 400–500 ft./min. or above and, at these high speeds, applying accurate beads of adhesive perpendicular to the direction of the conveying path has been a problem inadequately addressed by prior siftproof packaging systems. With the prior art high-speed siftproof packaging methods, beads of adhesive have been applied only in the direction of the conveying path in order to deal with this problem. This results in the use of much more adhesive than necessary to create a siftproof pattern and necessitates the use of multiple side-by-side adhesive dispensing guns and/or nozzles mounted adjacent the conveying path.

To solve these and other problems in the art, it would be desirable to provide a method of applying a siftproof pattern of adhesive to the major and minor flaps of a container while using less adhesive and a lower number of adhesive dispensing components while still maintaining a high production rate in a high speed packaging operation.

SUMMARY OF THE INVENTION

The present invention provides an apparatus and method for applying adhesive to respective first and second major flaps and first and second minor flaps of a container in a siftproof pattern. The container is moved along a conveying path with the major flaps being folded in an outwardly extending position. While the container moves along the conveying path, first and second adhesive dispensing guns are moved relative to the container while dispensing beads of adhesive therefrom along respective edges of the major and minor flaps proximate leading and trailing edges of the container and in directions generally perpendicular to the conveying path. These perpendicular beads may be applied starting on the outer edges of major flaps and moving inboard toward the minor flaps or vice versa. In one exemplary embodiment, the perpendicular beads are applied to the flaps of the container by guns which are mounted for pivotal movement about axes oriented generally parallel to the conveying path. In another exemplary embodiment, the first and second guns are simultaneously movable along directions parallel and perpendicular to the conveying path to dispense the adhesive beads to the flaps. In this embodiment, the first and second guns are positioned above a container and move synchronously with the container in a direction parallel to the conveyor path, while dispensing adhesive, so that the location and orientation of the beads may be more precisely controlled.

In yet another exemplary embodiment, the first and second guns are moveable along a linear path which is oblique with respect to the conveyor path. Advantageously, the speed of the first and second guns along the oblique path may be controlled so that the first and second guns are positioned over a container and move synchronously with the container moving along the conveyor, whereby the orientation and location of the beads applied to the flaps may be more precisely controlled.

The apparatus further includes a third, stationary adhesive dispensing gun positioned to dispense a bead of adhesive to an outboard edge of one of the major flaps, along a direction parallel to the conveyor path as the container is moved along the conveyor beneath the third gun.

This parallel bead is dispensed between, and adjoins, respective perpendicular beads which were dispensed along portions of the major flap corresponding to the leading and trailing edges of the container. The major flaps are then folded and sealed to the minor flaps by folding the first major flap onto the minor flaps and then folding the second major flap onto the first major flap.

The first and second guns are turned on and off at specific intervals so that the perpendicular beads are only applied to the desired portions of the major and minor flaps. Quick movements of the first and second guns perpendicular to the direction of the conveying path will result in the necessary generally perpendicular beads of adhesive at opposite ends of the major and minor flaps. Electric gun movers, such as linear actuators or servomotors with rotatable outputs, may be used to facilitate quick transverse movement relative to the conveying path. Even with the speed of the container along the conveying path reaching 400–500 ft./min. or above, the adhesive beads necessary in the direction generally perpendicular to the conveying path may be made, while the longer sealing bead extending in the direction of the conveying path is easily placed by the stationary third gun.

These and other objects, advantages, and features of the invention will become more readily apparent to those of ordinary skill in the art upon review of the following detailed description of the preferred embodiments, taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION OF THE PREFERRED EMBODIMENTS

Figure 1:
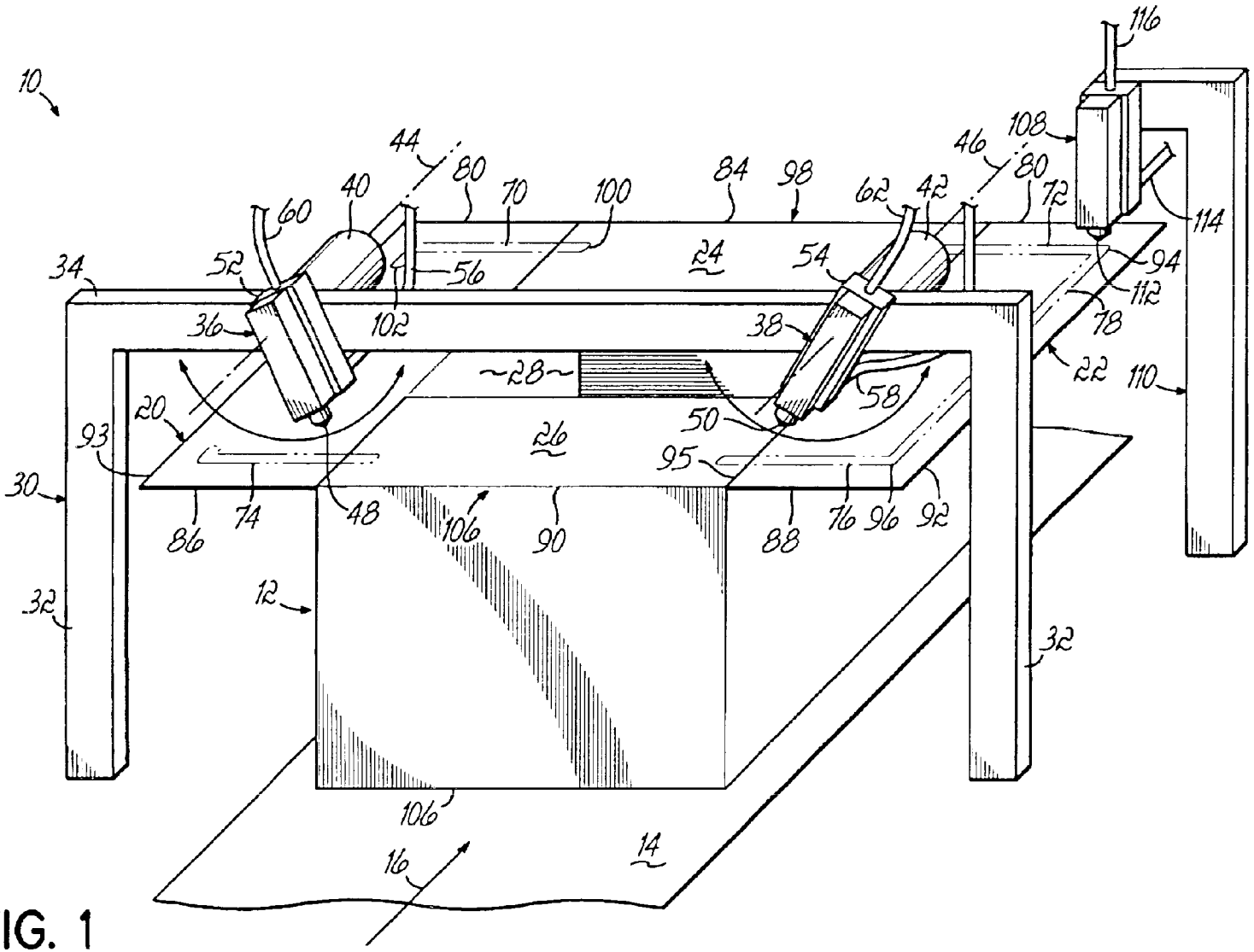
FIG. 1 is a partial perspective view schematically illustrating an adhesive dispensing system in accordance with one aspect of the present invention for applying a siftproof adhesive pattern to a container.
Figure 2:
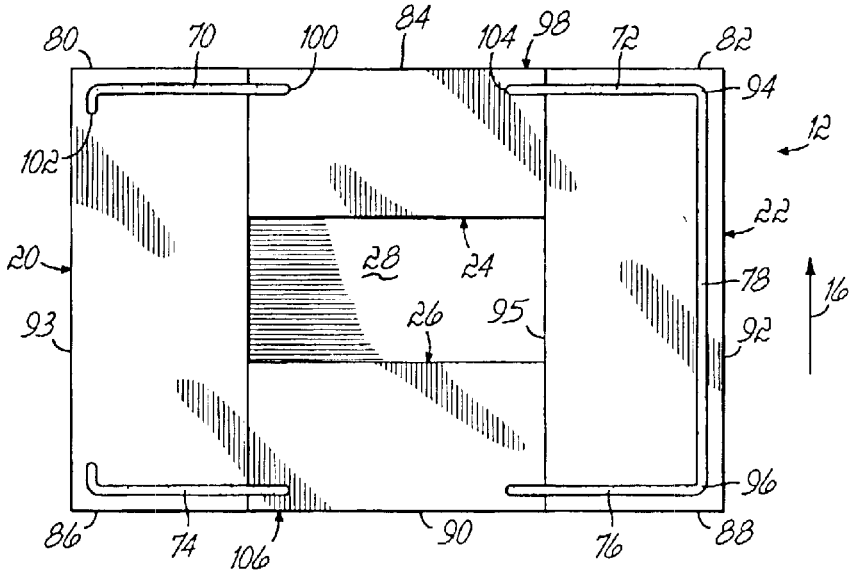
FIG. 2 is a top plan view of the container shown in FIG. 1, illustrating a siftproof pattern in accordance with one embodiment of the present invention.

Referring to FIGS. 1 and 2, an adhesive dispensing apparatus 10 is illustrated for applying adhesive siftproof pattern to a container 12. The container 12 travels along a conveyor 14 along a path indicated by a directional arrow 16. The conveyor 14 is schematically illustrated as a belt, however, in practice, such conveyors may take many different forms depending on the packaging operation and the container requirements. As shown more specifically in FIG. 2, the container 12 includes a first major flap 20, a second major flap 22, a first minor flap 24 and a second minor flap 26. The minor flaps 24, 26 are folded inwardly toward an interior 28 of the container 12, while the major flaps 20, 22 are folded outwardly with respect to the container interior 28. In this configuration, the container 12 is prepared for receipt of the siftproof adhesive bead pattern to be discussed below.

As shown in FIG. 1, the apparatus 10 includes a first support 30 having vertical support members 32 coupled to a horizontal support member 34. First and second adhesive dispensing guns 36, 38 are pivotally mounted to the horizontal member 34 and are coupled to motors 40, 42 which operate to pivot the adhesive dispensing guns 36, 38 about axes 44, 46 which are parallel to the conveying direction 16. Motors 40, 42 and other motors described herein may be servomotors, stepper motors, or any other type of motor which can be operated to control the motion of the adhesive dispensing guns. The first and second adhesive dispensing guns 36, 38 are configured to dispense adhesive from respective nozzles 48, 50 in an on/off fashion and are mounted to respective manifolds 52, 54. The adhesive dispensing guns 36, 38 can be pneumatic guns such as the H200 or H400 Series dispensing guns commercially available from Nordson Corporation of Westlake, Ohio, or electric guns, such as the Nordson® E350 Series. However, other types of pneumatically or electrically-actuated on/off type guns may be used as well. Adhesive is carried to the guns 36, 38 through their respective manifolds 52, 54 which are in fluid communication with adhesive supply hoses 56, 58. A pair of pressurized air hoses 60, 62 feed air to the manifolds 52, 54. The air is supplied through the manifolds 52, 54 to the guns 36, 38 in order to actuate the guns 36, 38 between on and off conditions.

When the guns 36, 38 are on, or in open positions, pressurized adhesive will flow through the hoses 56, 58, manifolds 52, 54, and nozzles 48, 50 and are applied to the container 12 to form the siftproof adhesive sealing beads of the present invention. With reference to FIG. 2, the siftproof adhesive pattern includes four adhesive bead sections 70, 72, 74, 76 that extend along directions which are substantially perpendicular to the conveying direction 16 and one adhesive bead section 78 that extends along a direction which is substantially parallel to the conveying direction 16. First and second perpendicular adhesive beads 70, 72 extend along first side edges 80, 82 of the first and second major flaps 20, 22 and along portions of a folded edge 84 of the first minor flap 24. Similarly, the third and fourth perpendicular adhesive beads 74, 76 extend along second side edges 86, 88 of the first and second major flaps 20, 22 and along portions of the folded edge 90 of the second minor flap 26. The parallel adhesive bead 78 extends along the free edge 92 of the second major flap 22 and joins with end portions 94, 96 of the second and fourth perpendicular adhesive beads 72, 76 to form a continuous length of adhesive bead having a generally C shape.

With continued reference to FIGS. 1 and 2, operation of the adhesive dispensing system 10 to create the siftproof adhesive pattern shown in FIG. 2 will now be described. The container 12 is moved along the conveyor 14 generally in the direction of the arrow 16. As the leading edge 98 of the container 12 passes beneath the first and second adhesive dispensing guns 36, 38, the motors 40, 42 are actuated to pivot the adhesive dispensing guns 36, 38 about their axes 44, 46 while the guns 36, 38 are turned on to dispense the first and second perpendicular adhesive beads 70, 72. The motors 40, 42 may move the guns 36, 38 such that the nozzles 48, 50 dispense the adhesive beads 70, 72 in directions either from inboard of the container 12 to the outboard edge, or vice versa, such that the first and second perpendicular beads 70, 72 are laid approximately at locations 100 to 102 and 104 to 94, respectively, as the container 12 continues to advance along the conveyor 14. After the first and second adhesive beads 70, 72 have been applied to the container 12, the first and second adhesive dispensing guns 36, 38 are turned off.

When the trailing edge 106 of the container 12 passes beneath the first and second adhesive dispensing guns 36, 38, the guns 36, 38 are turned on again and the motors 40, 42 are actuated to pivot the first and second adhesive dispensing guns 36, 38 to apply the third and fourth perpendicular adhesive beads 74, 76 in a manner similar to that described above for the first and second adhesive dispensing beads 70, 72. After the third and fourth perpendicular adhesive beads 74, 76 have been applied to the container 12, the first and second adhesive dispensing guns 36, 38 are turned off again.

While the operation of adhesive dispensing guns 36, 38 is described and illustrated herein as being turned on and off to dispense the perpendicular adhesive beads 70, 72 and 74, 76 simultaneously, it will be recognized that these, and other adhesive dispensing guns described herein, may be configured to turn on and off at different times instead. For example, one gun may be positioned upstream or downstream of the other.

The container 12 continues to advance along the conveyor 14 and the second major flap 22 passes beneath a third adhesive dispensing gun 108 mounted to a second support 110, located downstream of the first and second guns 36, 38. The third adhesive dispensing gun 108 includes a nozzle 112 and is coupled to an adhesive supply hose 114 and an air hose 116 for operation in a manner similar to first and second adhesive dispensing guns 36 and 38. As the leading edge 98 of the container passes beneath the third adhesive dispensing gun 108, the third gun 108 is turned on to dispense the parallel adhesive bead 78 along the free edge 92 of the second major flap 22 and between the second and fourth perpendicular adhesive beads 72, 76. As the trailing edge 106 passes beneath the third adhesive dispensing gun 108, the third gun 108 is turned off.

Figure 3:
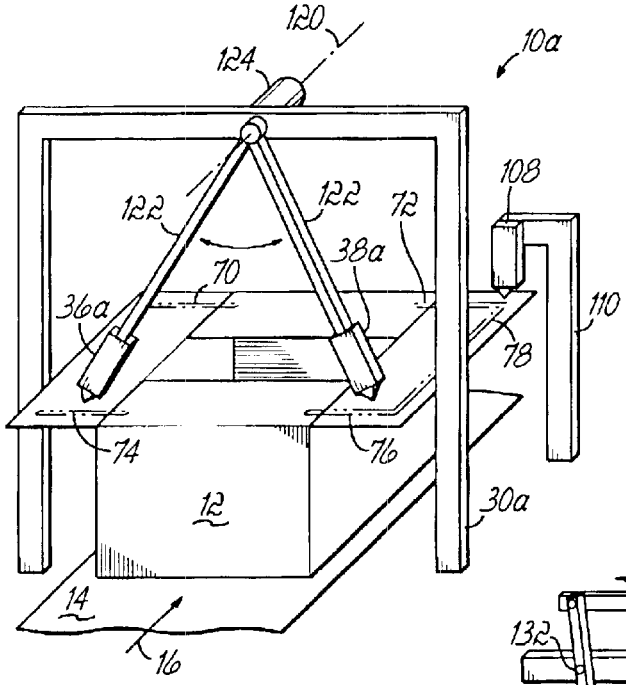
FIG. 3 is a perspective view illustrating an adhesive dispensing system in accordance with a second aspect of the present invention.

FIG. 3 depicts an alternative exemplary embodiment of an apparatus 10*a* for applying the siftproof pattern of adhesive according to the present invention. In the alternative embodiments hereinafter described, elements which are similar to those described above with respect to FIGS. 1 and 2 are similarly numbered. In the embodiment shown in FIG. 3, the first and second adhesive dispensing guns 36*a*, 38*a* are mounted to pivot about a common axis 120 by extension arms 122. A single motor 124 is used to rotate the first and second adhesive dispensing guns 36*a*, 38*a* about the axis 120 to thereby apply the first, second, third and fourth perpendicular adhesive beads 70, 72, 74, 76. Specifically, as the leading edge of the container 98 passes beneath the first and second adhesive dispensing guns 36*a*, 38*a*, the motor 124 is actuated to move the adhesive dispensing guns 36*a*, 38*a* in either a clockwise or counterclockwise direction to dispense the first and second perpendicular adhesive beads 70, 72 while the container 12 continues to travel along the conveyor 14. After the first and second adhesive beads 70, 72 have been applied to the container flaps 20, 22, 24, the first and second adhesive dispensing guns 36*a*, 38*a* are turned off. As the trailing edge 106 of the container 12 passes-beneath the first and second adhesive dispensing guns 36*a*, 38*a*, the first and second guns 36*a*, 38*a* are turned on again and the motor 124 is actuated to rotate the first and second guns 36*a*, 38*a* about the axis 120 to apply the third and fourth perpendicular beads 74, 76 along the side edges 86, 88 of the first and second major flaps 20, 22 and portions of the folded edge 90 of the second minor flap 26. The first and second adhesive dispensing guns 36*a*, 38*a* are turned off again and the container 12 continues to advance along the conveyor 14. As the leading edge 98 of the container 12 passes beneath the third adhesive dispensing gun 108, the third gun 108 is turned on and applies the parallel adhesive bead 78 to the free edge 92 of the second major flap 22 as the container 12 travels along the conveyor 14. As the trailing edge 106 of the container 12 passes beneath the third adhesive dispensing gun 108, the gun 108 is turned off to complete the siftproof pattern.

Figure 4:
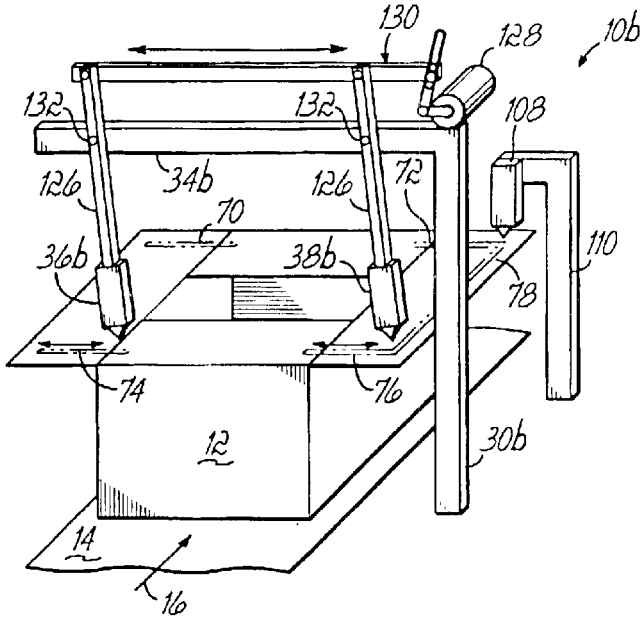
FIG. 4 is a perspective view illustrating an adhesive dispensing system in accordance with a third aspect of the present invention.

FIG. 4 illustrates yet another exemplary adhesive dispensing apparatus 10*b* for applying the siftproof pattern of the present invention. In this embodiment, the first and second adhesive dispensing guns 36*b*, 38*b* are suspended beneath the horizontal support member 34*b* from support rods 126 which are pivotally connected to the horizontal support member 34*b*. A motor 128 and crank linkage 130 are coupled to the ends of the support rods 126 whereby the motor 128 may cause the first and second adhesive dispensing guns 36*b*, 38*b* to pivot about their joints 132 to move transversely across the conveyor direction 16. In this manner, the first and second adhesive dispensing guns 36*b*, 38*b* may be controlled to dispense the first, second, third and fourth perpendicular adhesive beads 70, 72, 74, 76 in a manner similar to that described above for the adhesive dispensing apparatus 10, 10*a* of FIGS. 1 and 3.

Referring now to FIGS. 5–12, there is shown another exemplary adhesive dispensing apparatus 10*c* according to the present invention. In these figures, the adhesive dispensing apparatus 10*c* includes first and second adhesive dispensing guns 36*c*, 38*c* mounted for linear movement along a horizontal support 140 which is oriented such that the first and second adhesive dispensing guns 36*c*, 38*c* travel in a direction oblique to the direction 16 of the conveyor path 16. The pair of guns 36*c*, 38*c* are mounted in spaced relationship on a horizontal arm 141 which is in turn mounted for linear movement along the length of the horizontal support 140. In an exemplary embodiment, the angle $\alpha$ between the direction of the first and second adhesive dispensing guns 36*c*, 38*c* and the conveyor direction 16 is 45 degrees. Advantageously, the movement of the first and second adhesive dispensing guns 36*c*, 38*c* along the horizontal support 140 may be controlled to closely match the speed of the container 12 along the conveyor 14 whereby the first and second adhesive dispensing guns 36*c*, 38*c* may apply the first, second, third and fourth perpendicular adhesive beads 70, 72, 74, 76 to the container flaps 20, 22, 24, 26 while the container 12 travels along the conveyor 14. With reference to FIGS. 2 and 5–8, the operation of this embodiment of the adhesive dispensing system 10*c* will be explained.

Figure 6:
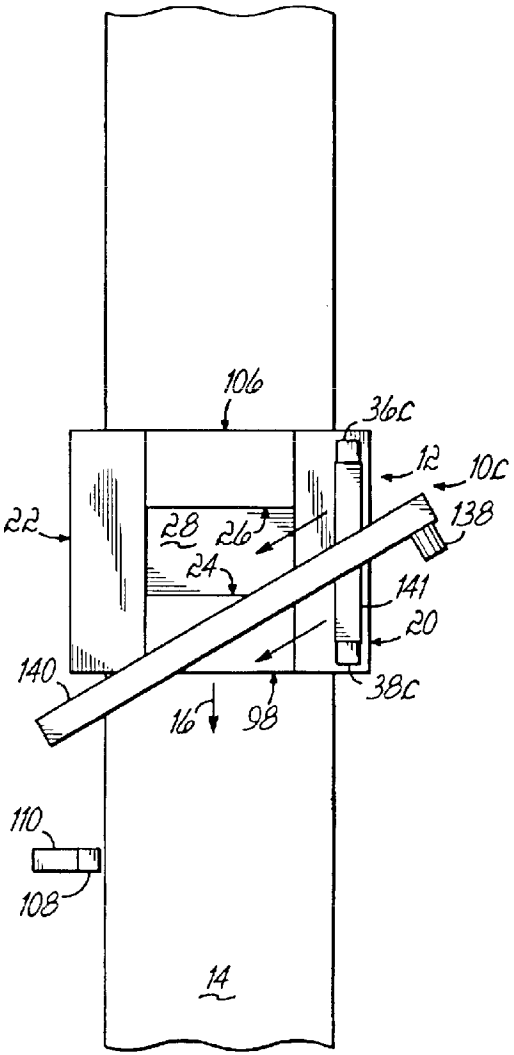
Figure 5:
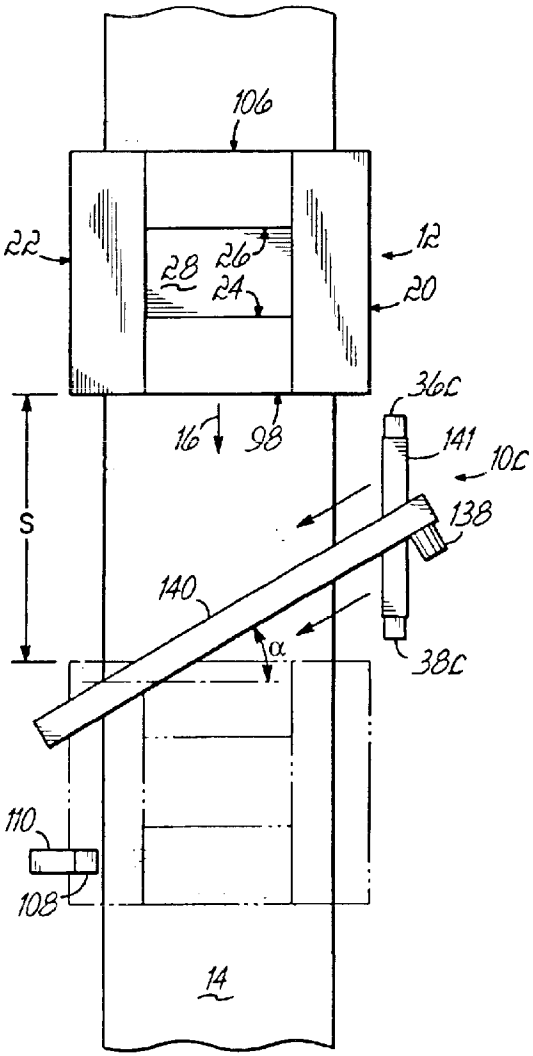

In FIG. 5, the container 12 is advanced along the conveyor 14 toward the first and second adhesive dispensing guns 36*c*, 38*c*. In FIG. 6, the container 12 is positioned beneath the first and second adhesive dispensing guns 36*c*, 38*c* and the first and second guns 36*c*, 38*c* are turned on to dispense adhesive to the first major flap 20 while a motor 138 is simultaneously actuated to move the first and second adhesive dispensing guns 36*c*, 38*c* along the horizontal support 140. Advantageously, the speed of the first and second guns 36*c*, 38*c* moving along the horizontal support 140 can be matched with the speed of the container 12 moving along the conveyor 14 such that the first, second, third and fourth adhesive beads 70, 72, 74, 76 may be dispensed to the flaps 20, 22, 24, 26 of the container 12 along a direction substantially perpendicular to the direction 16 of the conveyor 14. In particular, and with further reference to FIG. 2, the first and second adhesive dispensing guns 36*c*, 38*c* are turned on to dispense the first and third adhesive beads 70, 74 beginning at the free edge 93 of the first major flap 20 and extending along the side edges 80, 86 of the first major flap 20 and onto a portion of the first and second minor flaps 24, 26. The first and second guns 36*c*, 38*c* are then turned off while they continue to move along the horizontal support 140, matching the speed of the container 12 along the conveyor 14.

Figure 7:
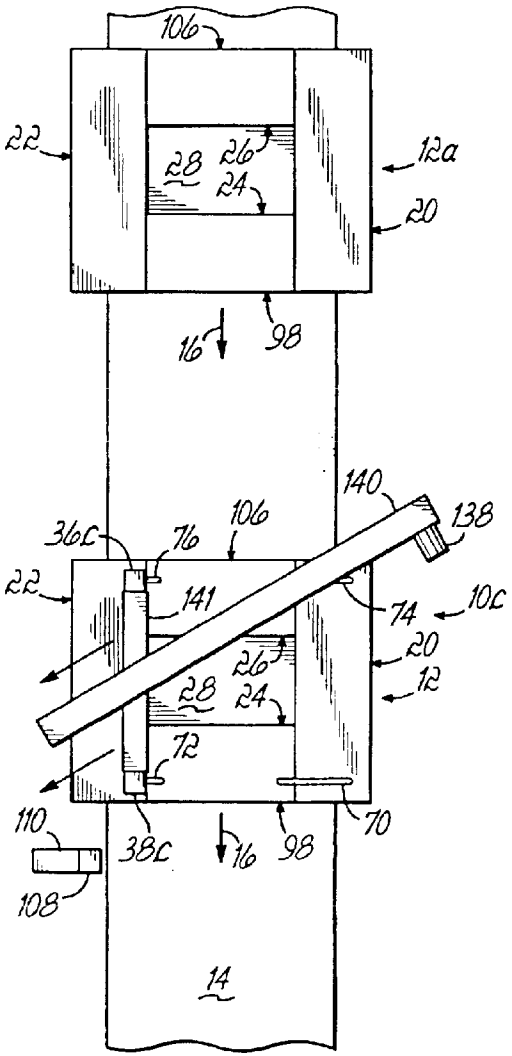
FIGS. 5–8 show a plan view of an adhesive dispensing system in accordance with a fourth aspect of the present invention.
Figure 8:
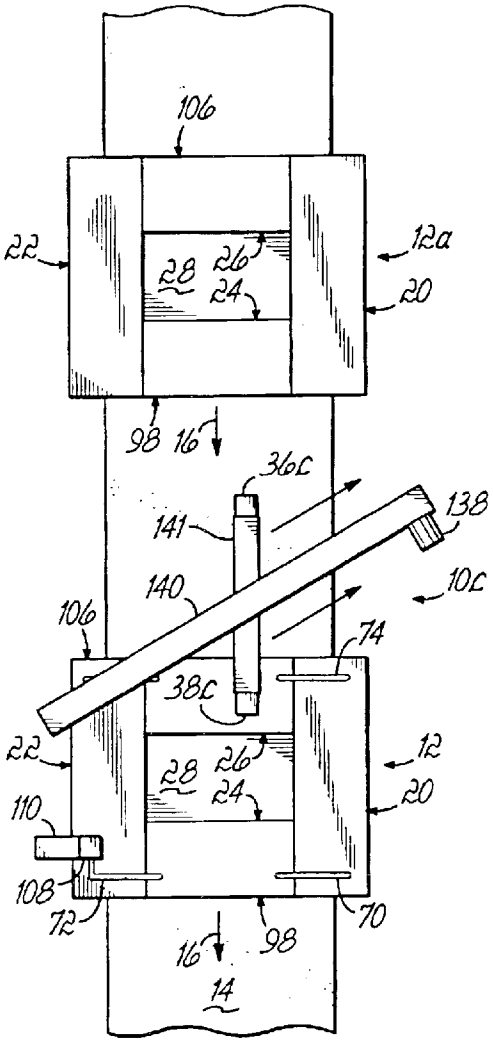

Referring to FIGS. 2 and 7, as the first and second adhesive dispensing guns 36*c*, 38*c* approach the second major flap 22, the first and second guns 36*c*, 38*c* are turned on to dispense adhesive to folded edge portions 84, 90 of the first and second minor flaps 24, 26 and along the first and second side edges 82, 88 of the second major flap 20 to create the second and fourth perpendicular adhesive beads 72, 76. When the first and second guns 36*c*, 38*c* approach the free edge 92 of the second major flap 22, the guns 36*c*, 38*c* are turned off and the first and second guns 36*c*, 38*c* are returned to the starting position, depicted in FIG. 5, in preparation for dispensing the perpendicular adhesive beads 70, 72, 74, 76 to a subsequent container 12*a* moving along the conveyor 14. As shown in FIG. 8, as the leading edge 98 of the container 12 passes beneath the third adhesive dispensing gun 108, the third gun 108 is turned on to dispense the parallel adhesive bead 78 along the free edge 92 of the second major flap 22 and between the second and fourth perpendicular adhesive beads 72, 76. The third gun 108 is then turned off.

The operation of the adhesive dispensing system 10*c* as described above for FIGS. 5–8 may be used to create a siftproof pattern of adhesive on the container 12 when the containers 12, 12*a* are spaced along the conveyor 14 a distance S which is greater than the dimensions of the container 12. When the spacing S between the containers 12, 12*a* is less than the dimensions of the container 12, a modified method of dispensing adhesive to the containers 12, 12*a* using the apparatus 10*c* will have to be utilized as will be explained with reference to FIGS. 2 and 9–12.

Figure 10:
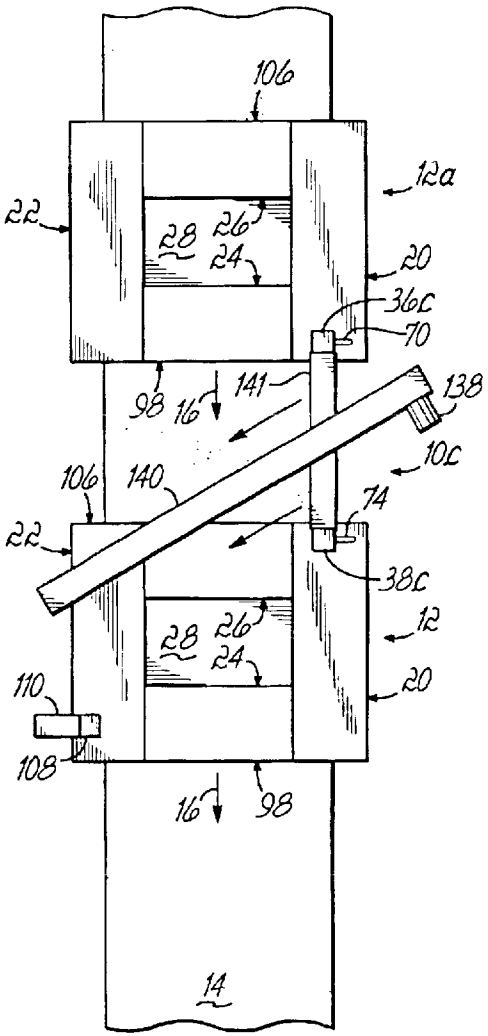
FIGS. 9–12 depict an alternate embodiment of the adhesive dispensing system of FIGS. 5–8.
Figure 9:
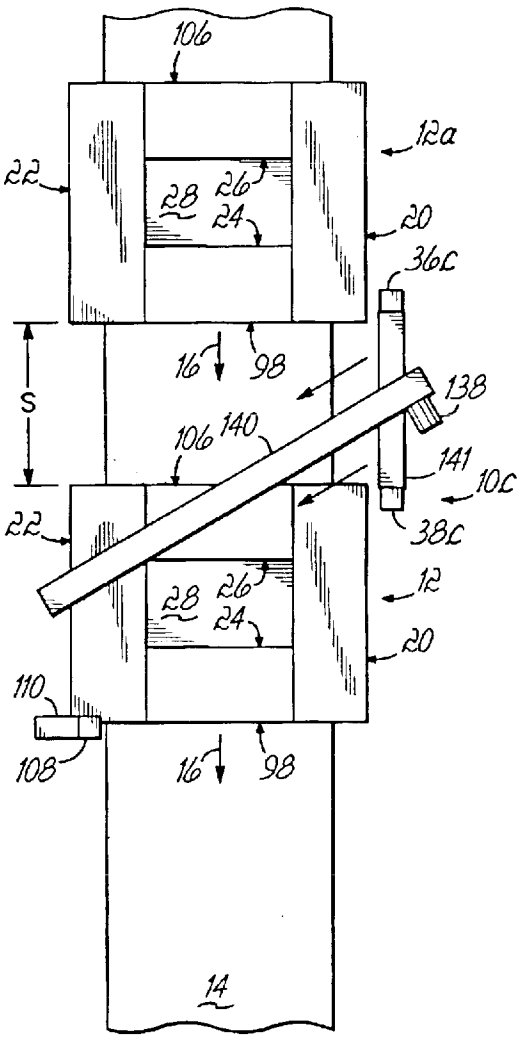

Referring to FIGS. 2 and 9, the first and second adhesive dispensing guns 36*c*, 38*c* are moved along the horizontal support 140 to dispense the perpendicular adhesive beads 70, 72, 74, 76 to the trailing and leading edges 106, 98 of successive containers 12, 12*a*, 12*b* moving along the conveyor 14. As the trailing edge 106 of one container 12 and the leading edge 98 of another container 12*a* pass beneath the first and second adhesive dispensing guns 36*c*, 38*c*, the motor 138 is actuated to move the first and second guns 36*c*, 38*c* linearly along the horizontal support 140 to track the speed of the containers 12, 12*a* along the conveyor 14 while the first and second adhesive dispensing guns 36*c*, 38*c* are turned on to apply first and third adhesive beads 70, 74 to the side edges 80, 86 of the first major flaps 20 (see FIG. 2) and folded side portions 84, 90 of the first and second minor flaps 24, 26 (see FIG. 2) of containers 12*a* and 12, respectively, as depicted in FIG. 10. The first and second guns 36*c*, 38*c* are then turned off as the containers 12, 12*a* advance along the conveyor 14 and the first and second guns 36*c*, 38*c* continue to move along the horizontal support 140.

Figure 11:
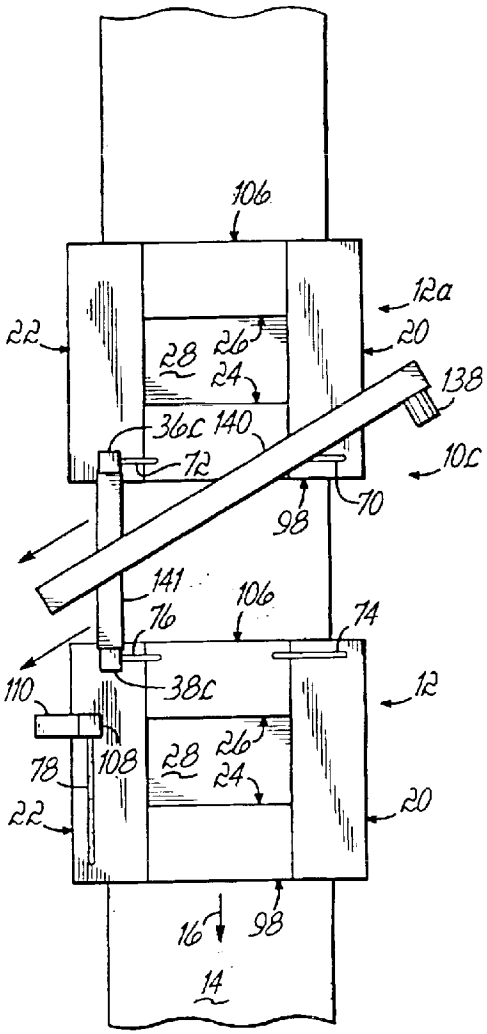

When the first and second guns 36*c*, 38*c* approach the folded edges 95 of the second major flaps 22 of the containers 12, 12*a*, the first and second adhesive dispensing guns 36*c*, 38*c* are turned on to dispense second and fourth perpendicular adhesive beads 72, 76 to side edge portions 84, 90 of the first and second minor flaps 24, 26 and the side edges 82, 88 of the second major flaps 22 of containers 12*a* and 12, respectively, as depicted in FIG. 11. As the first and second guns 36*c*, 38*c* approach the free edges 92 of the second major flaps 22, the guns 36*c*, 38*c* are turned off to complete the second and fourth perpendicular adhesive beads 72, 76 on containers 12*a* and 12, respectively.

As the leading edge 98 of container 12 passes beneath the third adhesive dispensing gun 108, the third gun 108 is turned on to dispense the parallel bead 78 along the free edge 92 of the second major flap 22. As the trailing edge 106 passes beneath the third adhesive dispensing gun 108, the third gun 108 is turned off to complete the parallel bead 78. After the second and fourth adhesive dispensing beads 72, 76 have been applied to the containers 12, 12*a*, the first and second guns 36*c*, 38*c* are returned to the starting position depicted in FIG. 9 in preparation for dispensing adhesive to successive container 12*b* moving along conveyor 14 as described above. Because adhesive dispensing system 10*c* is configured to dispense adhesive to respective trailing and leading edges 106, 98 of successive containers 12, 12*a* at the same time, it will be recognized that the very first container 12 of a run will not have a perpendicular bead 72 applied proximate the first side edge 82 of the second major flap 22. Accordingly, this bead 72 may be applied manually or by pre-manipulation of guns 36*c* and 38*c* prior to commencing automatic operation of the system.

Figure 13:
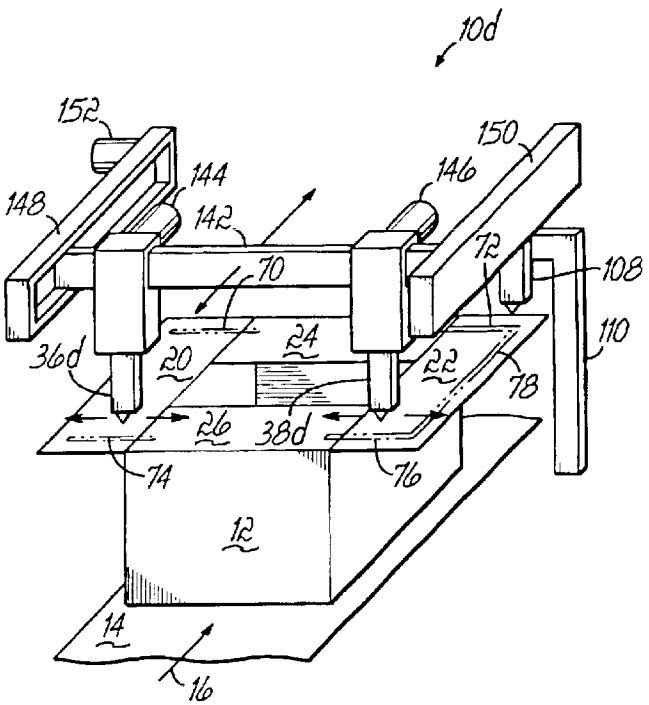
FIG. 13 is a perspective view illustrating an adhesive dispensing system in accordance with a fifth aspect of the present invention.
Figure 12:
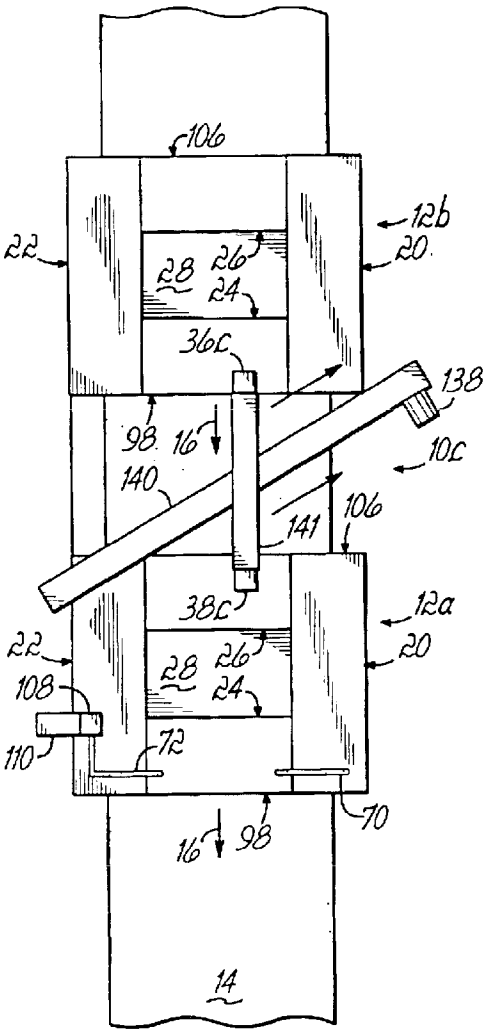

Referring to FIG. 13, there is shown yet another exemplary adhesive dispensing system 10*d* for applying the siftproof pattern of the present invention. In this embodiment, the first and second adhesive dispensing guns 36*d*, 38*d* are mounted on a first horizontal support 142 and are actuated by motors 144, 146 to move linearly along the horizontal support 142. In addition, the horizontal support 142 is mounted for linear movement along second and third horizontal members 148, 150 which extend in a direction along the length of the conveyor 14. A third motor 152 is coupled to the first horizontal support member 142 to move the first horizontal support member 142 in a direction parallel to the direction 16 of the conveyor 14 along horizontal members 148, 150.

In use, the first and second adhesive dispensing guns 36*d*, 38*d* are actuated to move transverse to the conveyor direction 16 and the first horizontal support member 142 is actuated to move parallel to the conveyor direction 16 while the first and second adhesive dispensing guns 36*d*, 38*d* are turned on to dispense the perpendicular adhesive beads 70, 72, 74, 76 to flaps 20, 22, 24, 26 of container 12. Advantageously, the third motor 152 may control the speed of the first horizontal support member 142 to closely match the speed of the container 12 along the conveyor 14 whereby the perpendicular adhesive beads 70, 72, 74, 76 may be applied to the flaps 20, 22, 24, 26 of the container 12 in a much more controlled fashion. Specifically, as the leading edge 98 of the container 12 passes beneath the first and second adhesive dispensing guns 36*d*, 38*d*, the guns 36*d*,

38*d* are turned on and the first and second motors 144, 146 are actuated to move the first and second guns 36*d*, 38*d* along the first horizontal support 142 to dispense the first and second perpendicular adhesive beads 70, 72 to the side edges 80, 82 of the first and second major flaps 20, 22 and portions 84 of the first minor flap 24 while the third motor 152 is actuated to move the first horizontal support 142 in a direction along the conveyor path 16 and at a speed substantially similar to the container 12. After the first and second perpendicular beads 70, 72 have been applied to the container 12, the first and second adhesive guns 36*d*, 38*d* are turned off and the third motor 152 returns the horizontal support 142 to its starting position.

As the trailing edge 106 of the container 12 passes beneath the first and second adhesive dispensing guns 36*d*, 38*d*, the first and second guns 36*d*, 38*d* are turned on and the first and second motors 144, 146 are actuated to move the guns 36*d*, 38*d* in a direction transverse to the conveyor direction 16 such that the third and fourth perpendicular beads 74, 76 are applied to the container 12 while the third motor 152 is actuated to move the horizontal support 142 in a direction along the conveyor direction 16 and at a speed which is substantially similar to the speed of the container 12. After the third and fourth perpendicular beads 74, 76 have been applied to the container 12, the first and second adhesive dispensing guns 36*d*, 38*d* are turned off and the third motor 152 returns the horizontal support 142 to its starting position. As the leading edge of the container 106 passes beneath the third adhesive dispensing gun 108, the third gun 108 is turned on to dispense the parallel adhesive bead 78 along the free edge 92 of the second major flap 22 and between the second and fourth perpendicular adhesive beads 72, 76. After the parallel bead 78 has been applied to the second major flap 22, the third adhesive dispensing gun 108 is turned off.

Figure 14:
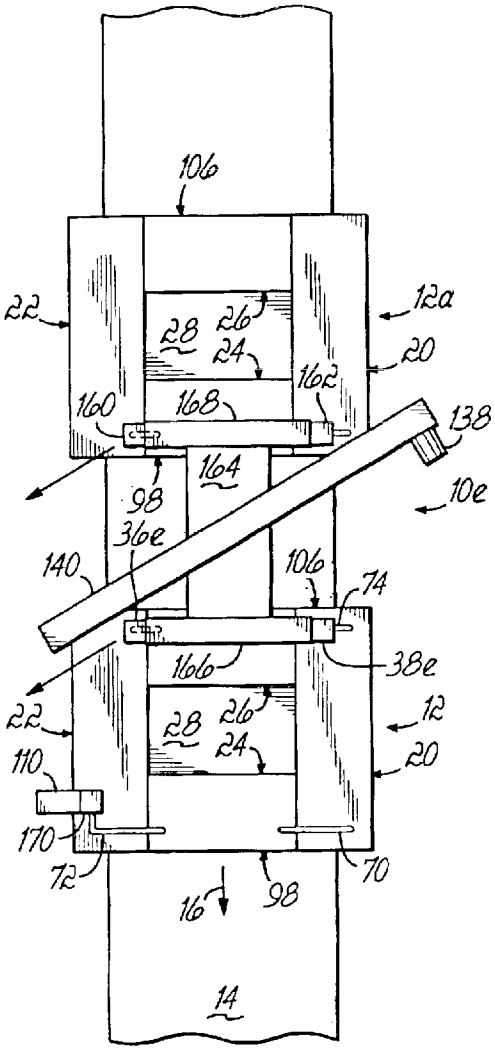
FIG. 14 is a plan view of an adhesive dispensing system in accordance with a sixth aspect of the present invention.

FIG. 14 depicts another exemplary adhesive dispensing system 10*e*, similar to system 10*c* of FIGS. 5–12, but having additional adhesive guns mounted to horizontal support 140 to accommodate increased line speeds. In the exemplary embodiment shown, first and second adhesive guns 36*e*, 38*e* and, in addition, third and fourth adhesive dispensing guns 160, 162 are mounted to horizontal support 140 by a carriage 164 which is moveable along support 140 so that the adhesive dispensing guns 36*e*, 38*e*, 160, 162 travel in a direction which is oblique to the conveyor path 16. The adhesive dispensing guns 36*e*, 38*e*, 160, 162 may be coupled to first and second manifolds 166, 168, respectively.

Operation of the adhesive dispensing system 10*e* is similar to the system 10*c* previously described, wherein the guns 36*e*, 38*e*, 160, 162 dispense adhesive to the first and second major flaps 20, 22 and portions of the first and second minor flaps 24, 26 as container 12 travels along conveyor 14. In particular, as successive cartons 12, 12*a* are moved along conveyor 14 and pass beneath the horizontal support 140, a motor 138 is actuated to move the guns 36*e*, 38*e*, 160, 162 along the horizontal support 140 to track the speed of the containers 12, 12*a* along the conveyor 14 and the first, second, third and fourth adhesive dispensing guns 36*e*, 38*e*, 160, 162 are turned on to dispense adhesive beads to the containers 12, 12*a*. The first and second guns 36*e*, 38*e* apply the third and fourth adhesive beads 74, 76 to the first and second major flaps 20, 22 and portions of the second minor flap 26 of the first carton 12 while the third and fourth adhesive dispensing guns 160, 162 apply the first and second adhesive beads 70, 72 to the first and second major flaps 20, 22 and portions of the first minor flap 24 of the second carton 12*a*. After the first, second, third and fourth adhesive beads have been applied to the containers 12, 12*a*, the adhesive guns 36*e*, 38*e*, 160, 162 are turned off and the carriage 164 is moved back along horizontal support 140 toward the starting position so that the process may be repeated with successive containers moving along conveyor 14.

As the leading edge 98 of successive containers 12, 12*a* pass beneath the fifth, stationary adhesive dispensing gun 170, the fifth gun 170 is turned on to dispense the parallel bead 78 along free edge 92 of the second major flap 22. As the trailing edge 106 passes beneath the fifth gun, the fifth gun 170 is turned off to stop the flow of adhesive and complete the parallel bead 78.

Figure 15:
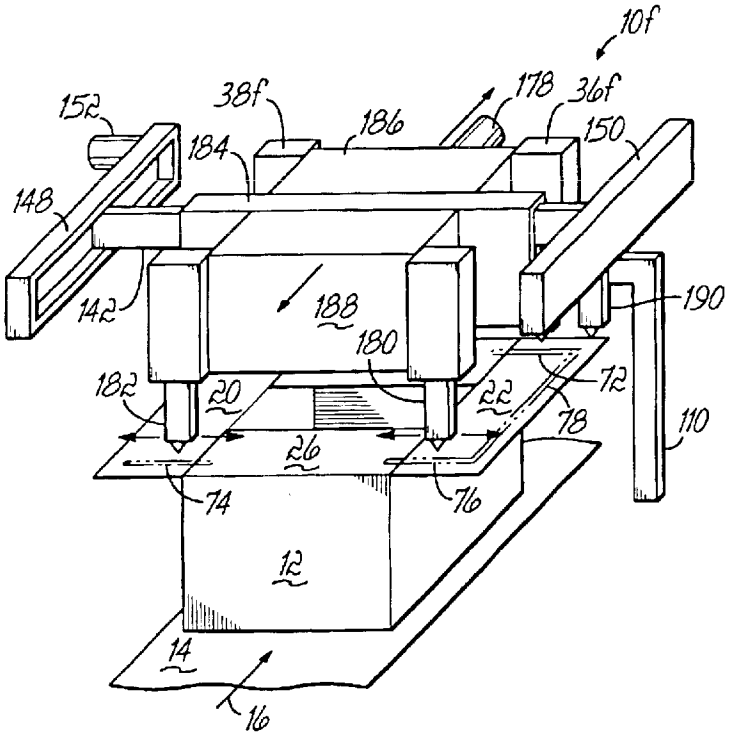
FIG. 15 is a perspective view illustrating an adhesive dispensing system in accordance with a seventh aspect of the present invention.

Referring to FIG. 15, there is shown yet another exemplary adhesive dispensing system 10*f*, similar to the adhesive dispensing system 10*d* shown in FIG. 13, but having four adhesive dispensing guns mounted to a horizontal support 142. In this embodiment, first, second, third and fourth adhesive dispensing guns 36*f*, 38*f*, 180, 182 are mounted to a first horizontal support member 142 by a carriage 184 which is movable along the first horizontal support 142 to thereby move the first, second, third and fourth adhesive dispensing guns 36*f*, 38*f*, 180, 182 transversely with respect to conveyer direction 16. As previously described above, with respect to FIG. 13, first horizontal support 142 is movable along second and third horizontal support members 148, 150 in a direction generally parallel to the conveyer direction 16. The adhesive dispensing system 10*f* further includes a fifth, static adhesive dispensing gun 190 mounted to support 110 downstream of the first, second, third and fourth guns 36*f*, 38*f*, 180, 182.

Operation of the adhesive dispensing system 10*f* will now be described with reference to FIGS. 2 and 15. In use, motor 152 is actuated to move the first horizontal support member 142 in a direction generally parallel to the conveyer direction 16, while closely matching the speed of a container 12 moving along the conveyer 14, and another motor 178 is actuated to move carriage 184 along the first horizontal support member 142 in a direction transverse to the conveyer direction 16 while first, second, third and fourth adhesive dispensing guns 36*f*, 38*f*, 180, 182 are turned on to dispense parallel adhesive beads 70, 72, 74, 76 to the major and minor flaps 20, 22, 24, 26 of container 12 in a manner similar to that previously described. Specifically, first and second adhesive dispensing guns 36*f*, 38*f* may be used to apply perpendicular adhesive beads 72, 70, respectively, to the first and second major flaps 20, 22 and portions of the first minor flap 24 near the leading edge 98 of container 12 while the third and fourth adhesive dispensing guns 180, 182 apply perpendicular adhesive beads 76, 74, respectively, to the major flaps 20, 22 and portions of the second minor flap 26 near the trailing edge 106 of container 12 as the container 12 moves along the conveyer 14.

Alternatively, first and second adhesive dispensing guns 36*f*, 38*f* may be used to apply perpendicular adhesive beads 74, 76 proximate the trailing edge 106 of a first container 12 while the third and fourth adhesive dispensing guns 180, 182 apply perpendicular beads 70, 72 to the leading edge 98 of a subsequent container 12*a*, in a manner similar to that previously described with respect to FIGS. 9–12. Operation of the adhesive dispensing system 10*f* in this manner is advantageous when containers 12, 12*a* are spaced along the conveyer 14 a distance which is less than the dimensions of the container 12.

After perpendicular adhesive beads 70, 72, 74, 76 have been applied to container 12, the first, second, third and fourth adhesive dispensing guns 36*f*, 38*f*, 180, 182 are turned off and the first horizontal support 142 is moved along the second and third horizontal supports 148, 150 to reposition the adhesive dispensing guns 36*f*, 38*f*, 180, 182 with respect to the next container 12 moving along conveyer 14. In an exemplary embodiment, carriage 184 may be controlled to move alternately from left to right, and then from right to left, with respect to FIG. 15, to dispense the perpendicular adhesive beads 70, 72, 74, 76 while accommodating high line speeds of cartons 12 moving along conveyer 14.

As the leading edge 98 of each container 12 passes beneath the fifth, stationary gun 190, the fifth gun 190 is turned on to dispense the parallel bead of adhesive 78 along a free edge 92 of the second major flap 22. As the trailing edge 106 of container 12 passes beneath the fifth gun 190, the fifth gun 190 is turned off to stop the flow of adhesive and to complete the parallel bead 78 in a manner previously described.

While the present invention has been illustrated by a description of various preferred embodiments and while these embodiments have been described in some detail, it is not the intention of the Applicants to restrict or in any way limit the scope of the appended claims to such detail. Additional advantages and modifications will readily appear to those skilled in the art. For example, it will be recognized that the motors 144, 146, 152 of the exemplary adhesive dispensing system 10*d* may be controlled to automatically adjust the spacing of adhesive dispensing guns 36*d*, 38*d* and the location of dispensed beads 70, 72, 74, 76 to accommodate various container sizes and arrangements. The invention in its broader aspects is therefore not limited to the specific details, representative apparatus, methods, and illustrative examples shown and described. Accordingly, departures may be made from such details without departing from the scope or spirit of the Applicant's general inventive concept.

Having described the invention, what is claimed is:

1. A method of applying adhesive to a container moving along a conveying path, the method comprising:

turning first and second adhesive dispensing guns on and dispensing adhesive to a surface of the container while the container is moving along the conveying path;

pivoting the first and second adhesive dispensing guns about at least one axis parallel to the conveying path while the container is moving along the conveying path to thereby apply the adhesive to the container along a direction generally perpendicular to the conveying path; and stopping the flow of adhesive from the first and second adhesive dispensing guns.

2. A method of applying adhesive to respective first and second major flaps and first and second minor flaps of a container in a siftproof pattern, the method comprising:

moving the container along a conveying path, said major flaps being folded in an outwardly extending position and said minor flaps being folded in an inwardly extending position;

moving a first dispensing gun relative to the container while dispensing a first bead of adhesive therefrom along respective first edges of the first major flap and the first minor flap in a direction generally perpendicular to the conveying path; stopping the dispensing of the first bead of adhesive;

moving a second dispensing gun relative to the container while dispensing a second bead of adhesive therefrom along the first edge of the second major flap and the first minor flap in a direction generally perpendicular to the conveying path; stopping the dispensing of the second bead of adhesive;

dispensing a third bead of adhesive from a third dispensing gun along a free edge of the second major flap along a direction generally parallel to the conveying path;

stopping the dispensing of the third bead of adhesive;

moving the first dispensing gun relative to the container while dispensing a fourth bead of adhesive therefrom along the second edge of the first major flap and the folded edge of the second minor flap in a direction generally perpendicular to the conveying path;

stopping the dispensing of the fourth bead of adhesive;

moving the second dispensing gun relative to the container while dispensing a fifth bead of adhesive therefrom along the second edge of the second major flap and folded edge of the second minor flap in a direction generally perpendicular to the conveying path; and stopping the dispensing of the fifth bead of adhesive.

3. The method of claim 2, wherein the steps of moving the first dispensing gun includes pivoting the gun about an axis generally parallel to the conveying path.

4. The method of claim 2, wherein the steps of moving the second dispensing gun includes pivoting the gun about an axis generally parallel to the conveying path.

5. The method of claim 2, wherein the first and second guns are moved simultaneously to dispense adhesive to the flaps.

6. A method of applying adhesive to respective first and second major flaps and first and second minor flaps of a container in a siftproof pattern, the method comprising:

moving the container along a conveying path, said major flaps being folded in an outwardly extending position and said minor flaps being folded in an inwardly extending position;

moving first and second adhesive dispensing guns relative to the container to dispense first and second adhesive beads along first and second side edges of the first major flap and along portions of the first and second minor flaps;

stopping the dispensing of the first and second adhesive beads;

moving the first and second adhesive dispensing guns relative to the container to dispense third and fourth adhesive beads along first and second side edges of the second major flap and along portions of the first and second minor flaps;

stopping the dispensing of the third and fourth adhesive beads;

dispensing a fifth bead of adhesive from a third dispensing gun along a free edge of the second major flap along a direction generally parallel to the conveying path; and stopping the dispensing of the fifth bead of adhesive.

7. The method of claim 6 wherein the steps of moving the first and second guns relative to the container include linearly moving the guns along a direction that is oblique to the conveying path.

8. A method of applying adhesive to respective first and second major flaps and first and second minor flaps of successive containers in a siftproof pattern, the method comprising:

moving successive containers along a conveying path, said major flaps being folded in an outwardly extending position and said minor flaps being folded in an inwardly extending position;

moving first, second, third and fourth adhesive dispensing guns relative to the containers while dispensing first, second, third and fourth adhesive beads along first and second side edges of the first and second major flaps and along portions of the first and second minor flaps;

stopping the dispensing of the first, second, third and fourth adhesive beads;

dispensing a fifth bead of adhesive from a fifth dispensing gun along a free edge of the second major flap along a direction generally parallel to the conveying path; and stopping the dispensing of the fifth bead of adhesive.

9. The method of claim 8, wherein the step of moving and dispensing adhesive from the first, second, third and fourth guns includes:

dispensing third and fourth adhesive beads from the first and second guns to the first and second major flaps and portions of the second minor flap of a first one of the containers; and dispensing first and second adhesive beads from the third and fourth guns to the first and second major flaps and portions of the first minor flap of a second one of the containers.

* * * * *